US005410965A

United States Patent [19]

DeVries

[11] Patent Number: 5,410,965

[45] Date of Patent: May 2, 1995

[54] BLANKET FOR A MAGNETIC CYLINDER

[75] Inventor: David G. DeVries, Lisle, Ill.

[73] Assignee: R. R. Donnelley & Sons Company, Lisle, Ill.

[21] Appl. No.: 985,030

[22] Filed: Dec. 3, 1992

[51] Int. Cl.[6] ..... B41F 27/00

[52] U.S. Cl. ..... 101/389.1; 101/383

[58] Field of Search ..... 101/389.1, 383, 384, 101/382.1, 415.1, 375, 217, DIG. 36; 428/909

[56] References Cited

U.S. PATENT DOCUMENTS

| | | | |
|---|---|---|---|
| 4,040,351 | 8/1977 | Faust | 101/389.1 |
| 4,402,265 | 9/1983 | Pickard | 101/389.1 |
| 4,628,815 | 12/1986 | Van Kanegan | 101/415.1 |
| 4,676,161 | 6/1987 | Peekna | 101/389.1 |
| 4,852,490 | 8/1989 | McEachern . | |

*Primary Examiner*—Edgar S. Burr
*Assistant Examiner*—Anthony H. Nguyen
*Attorney, Agent, or Firm*—Wood, Phillips, VanSanten, Clark & Mortimer

[57] ABSTRACT

A printing blanket is disclosed for use on a magnetic cylinder in a web offset press. The printing blanket comprises an elongate carrier plate of magnetic material having a length greater than a select circumference of the cylinder. An elongate blanket sheet has a length substantially equal to the select circumference of the cylinder. An adhesive secures the blanket sheet to an outer surface of the carrier plate with a trailing edge of the blanket sheet immediately adjacent a trailing edge of the carrier plate so that in use mounted to the cylinder at least a portion of the carrier plate overlaps a leading edge of the carrier plate.

18 Claims, 3 Drawing Sheets

BLANKET FOR A MAGNETIC CYLINDER

FIELD OF THE INVENTION

This invention relates to a printing blanket for use on a magnetic cylinder in a web offset press.

BACKGROUND OF THE INVENTION

In rotary offset printing, ink is applied to an image plate mounted on one cylinder. The ink is transferred to a resilient blanket on a second cylinder. A paper web is imprinted with the ink on the blanket. The plate and blanket cylinders have to hold the plate or blanket on the cylinder surface. Cylinders have been used which hold the plate magnetically. Magnetic cylinders must have sufficient holding capability for reliable operation in rotary web offset printing.

As discussed in Peekna, U.S. Pat. No. 4,676,161, and Wouch et al., U.S. Pat. No. 4,817,527, owned by the assignee hereof, a typical blanket for a magnetic cylinder includes a carrier plate of magnetic material having a length substantially equal to half the circumference of the cylinder. An elongate blanket sheet has a length also substantially equal to half the circumference of the cylinder. The blanket sheet is secured to an outer surface of the carrier plate. Two blankets are used on each cylinder. A concern has been raised that, in use, it is possible that peel-off can occur at the leading edge of either printing blanket. Also, circumferential displacement of the printing blanket about the cylinder can occur.

The present invention is intended to overcome one or more of the problems discussed above.

SUMMARY OF THE INVENTION

In accordance with the invention, a blanket for a magnetic cylinder is provided which prevents peel-off at a leading edge and which suppresses circumferential movement of the blanket.

Broadly, there is disclosed herein a printing blanket for use on a magnetic cylinder in a web offset press, the cylinder having a select circumference. The printing blanket comprises an elongate carrier plate of magnetic material having a length greater than the select circumference of the cylinder. An elongate blanket sheet has a length substantially equal to the select circumference of the cylinder. Means are provided for securing the blanket sheet to an outer surface of the carrier plate with a trailing edge of the blanket sheet immediately adjacent a trailing edge of the carrier plate so that in use mounted to the cylinder at least a portion of the carrier plate overlaps a leading edge of the carrier plate.

It is a feature of the invention that the carrier plate has a length substantially twice as long as the select circumference of the cylinder.

In accordance with one aspect of the invention the printing blanket comprises a two segment blanket having a two segment carrier plate and two segment blanket sheet. The securing means secures each blanket sheet segment to an outer surface of one carrier plate segment with a trailing edge of the blanket sheet segment immediately adjacent a trailing edge of the secured carrier plate segment so that in use mounted to the cylinder a portion of each carrier plate segment overlaps a leading edge of the other carrier plate segment.

There is disclosed in accordance with yet another aspect of the invention a printing blanket comprising a four segment blanket having a four segment carrier plate and four segment blanket sheet. The securing means secures each blanket sheet segment to an outer surface of one carrier plate segment with a trailing edge of the blanket sheet segment immediately adjacent a trailing edge of the secured carrier plate segment so that in use mounted to the cylinder a portion of each carrier plate segment overlaps a leading edge of another circumferentially adjacent carrier plate segment.

It is another feature of the invention that the carrier plate includes an offset bend immediately adjacent a leading edge of the blanket sheet.

It is a further feature of the invention that the carrier plate comprises a two-piece carrier plate and a trailing edge of a leading piece secured at an underside of a leading edge of a trailing piece.

Further features and advantages will readily be apparent from the drawings and from the specification.

DESCRIPTION OF THE INVENTION

Figure 1:
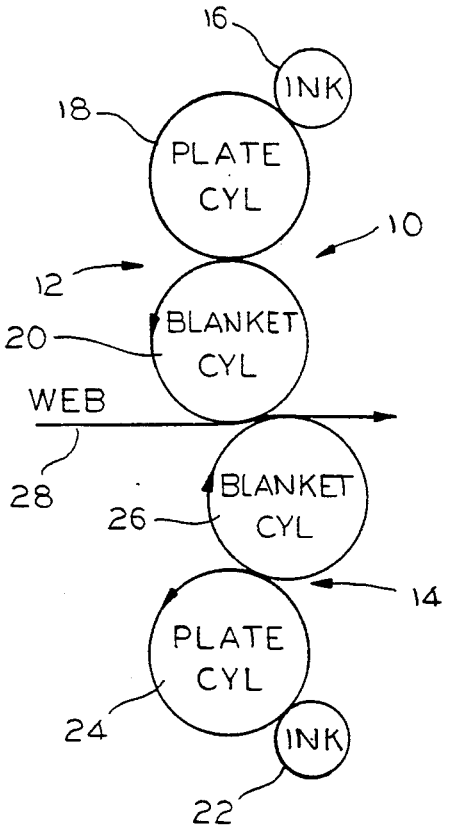
FIG. 1 is a diagram illustrating the physical arrangement of cylinders in a web offset printing press.

With reference to FIG. 1, a rotary offset press 10 for printing on two sides of a web is illustrated schematically. The press 10 includes an upper set 12 of cylinders and a lower set 14 of cylinders, each generally identical in operation. Particularly, the upper set 12 comprises an ink cylinder 16, a plate cylinder 18, and a blanket cylinder 20. The lower set 14 includes an ink cylinder 22, a plate cylinder 24, and a blanket cylinder 26. A web 28 of paper passes between the blanket cylinders 20 and 26.

In a printing operation, ink is applied via the respective ink cylinders 16 and 22 to the plate cylinders 18 and 24. The plate cylinder supports an image plate, discussed below relative to FIGS. 9–11, (not including a preformed image thereon representing areas for which ink is to be applied to the web 28. The ink is transferred from the image plate on each plate cylinder 18 and 24 to a resilient blanket on each respective associated blanket cylinder 20 and 26. The paper web 28 is imprinted on the top with ink on the blanket cylinder 20 and on the bottom with ink on the blanket cylinder 26.

Figure 2:
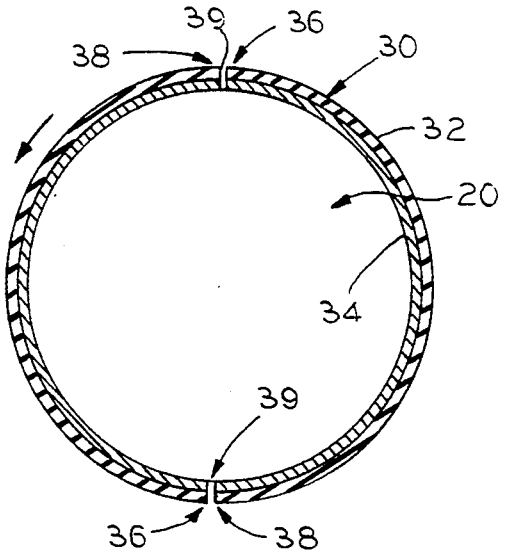
FIG. 2 (PRIOR ART)
FIG. 2 is a diagram illustrating a prior art printing blanket in section on a magnetic cylinder.

With reference to FIG. 2, a prior art two segment printing blanket 30 is illustrated mounted on a blanket cylinder 20. Each printing blanket 30 comprises a blanket sheet 32 bonded to a magnetic carrier plate 34. The printing blanket 32 and carrier plate 34 are substantially equal in length and, in fact, are substantially equal in length to half the circumference of the cylinder 20.

As illustrated in FIG. 2, the cylinder 20 rotates in a counter-clockwise direction defining a leading edge 36 and trailing edge 38 for each printing blanket 30. Gaps 39 exist between the leading and trailing edges 36 and 38, respectively of opposite segments. In the illustration of FIG. 2, each gap 39 is exaggerated in size for illustration purposes. In actuality, each gap 39 is on the order of, for example, 0.005 inches.

In accordance with the invention, a carrier plate is provided which is of a length greater than the circumference of the magnetic cylinder so that a portion of the carrier plate overlaps a leading edge of the carrier plate to prevent peel-off and to suppress circumferential movement of the blanket sheet and carrier plate on the magnetic cylinder.

Figure 3:
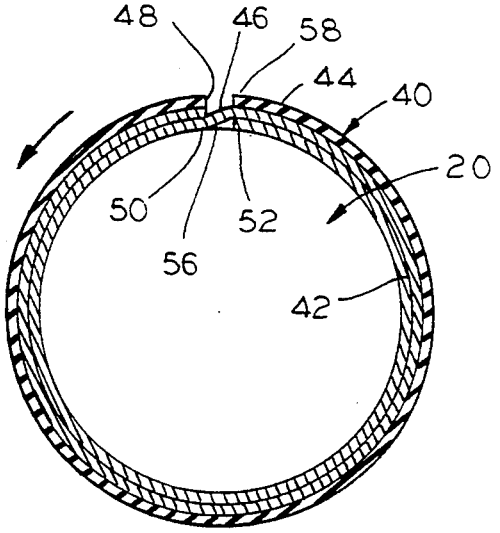
FIG. 3 is a diagram illustrating a printing blanket according to the invention in section mounted on a magnetic cylinder.

With reference to FIG. 3, a printing blanket 40 according to a first embodiment of the invention is illustrated. The printing blanket 40 comprises an elongate carrier plate 42 of magnetic material having a length approximately double the circumference of the magnetic cylinder 20. An elongate blanket sheet 44 has a length substantially equal to the circumference of the cylinder 20.

The offset printing blanket sheet 40 is a resilient sheet, generally a composite material of elastomer and fabric reinforcement. The carrier plate 42 is generally of flexible or rigid stainless steel. The blanket sheet 44 is adhesively secured to an outer surface 46 of the carrier plate 42. Particularly, the blanket sheet 44 is placed on the outer surface 46 with a trailing edge 48 of the blanket sheet immediately adjacent and aligned with a trailing edge 50 of the carrier plate 42.

Figure 4:
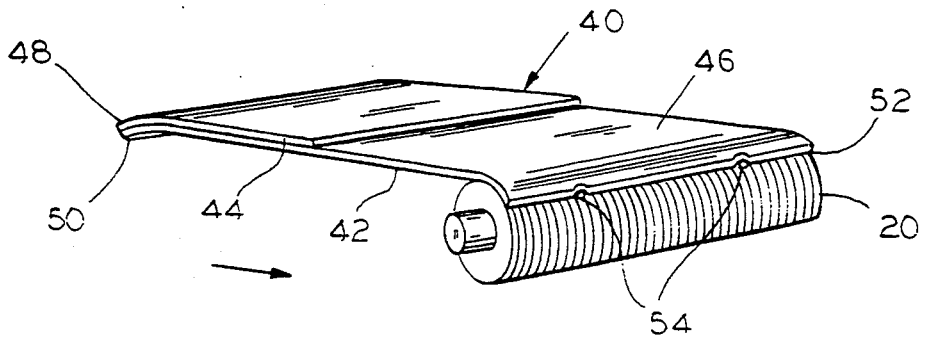
FIG. 4 is a perspective view illustrating a procedure for mounting the printing blanket of FIG. 3 on the magnetic cylinder.

Since the blanket sheet 48 is half the length of the carrier plate 42, the outer surface 46 of the carrier plate 42 adjacent a leading edge 52 is exposed, as illustrated in FIG. 4, prior to mounting. To mount the printing blanket 40 on the cylinder 20 the carrier plate leading edge 52 is positioned tangentially on the cylinder 20 in contact with registration pins 54. The cylinder 20 is then rotated to advance the printing blanket 40 as illustrated in the arrow of FIG. 4. Since the carrier plate 42 is twice as long as the circumference of the cylinder 20, it will complete two full revolutions prior to being completely installed. When completely installed, as illustrated in FIG. 3, the leading edge 52 of the carrier plate 42 is overlapped by another portion of the carrier plate 42. Particularly, the trailing portion of the carrier plate 42 underlying the blanket sheet 44 overlaps a leading portion of the carrier plate comprising the portion adjacent its leading edge not covered by the blanket sheet 44.

In order to provide an even outer circumferential surface, the carrier plate 42 includes an offset bend 56 at approximately its midpoint. The height of the bend corresponds to the thickness of the carrier plate material so that the outer surface of the blanket sheet 44 is of an even radial height throughout. As can be appreciated, the length of the bend 56 is exaggerated for purposes of illustration in FIG. 3. In actuality, the carrier plate 42 might be a thickness on the order of 0.015 inches with a bend of approximately equal height, as discussed above. As a result, a minimal gap on the order of 0.040 inches is provided between the blanket sheet trailing edge 48 and an opposite leading edge 58.

Figure 5:
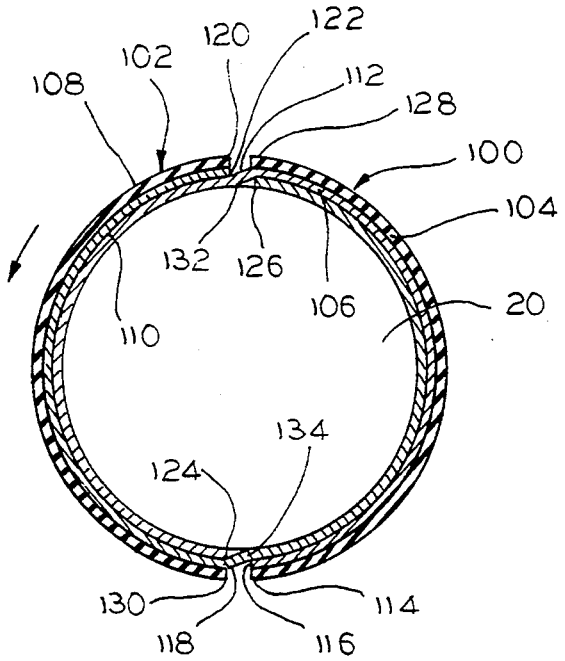
FIG. 5 is a diagram illustrating a printing blanket in section according to an alternative embodiment of the invention mounted on a magnetic cylinder.

Owing to the above described construction, the overlapping of the carrier plate leading edge 52 prevents peel-off and also suppresses circumferential movement of the printing blanket 40.

Where the press is intended to print two-around, the printing blanket may be provided in two 180° segments, 100 and 102, see FIG. 5. The first printing blanket segment 100 comprises a blanket segment 104 and carrier plate segment 106. The second printing blanket segment 102 comprises a blanket segment 108 and a carrier plate segment 110. Each carrier plate segment 106 and 110 is substantially equal in length to the circumference of the cylinder 20. Thus, both combined are approximately equal to double the circumference. Each blanket sheet segment 104 and 108 is approximately half the circumference of the cylinder 20 so that combined the blanket sheet segments 104 and 108 are substantially equal in length to the circumference of the cylinder 20.

Each blanket sheet segment 104 and 108 is adhesively secured to its associated carrier plate segment 106 and 110, respectively. Particularly, regarding the first segment 100, the blanket sheet segment 104 is secured to an outer surface 112 of the carrier plate segment 106 with a trailing edge 114 of the blanket sheet segment immediately adjacent a trailing edge 116 of the carrier plate segment 106. Similarly, respecting the second segment 102, the blanket sheet segment 108 is adhesively secured to an outer surface 118 of the carrier plate segment 110 with a trailing edge 120 of the blanket sheet segment 108 aligned and immediately adjacent a trailing edge 122 of the carrier plate segment 110. In use, the printing blanket segments 100 and 102 are mounted initially with the carrier plate segment leading edges 124 and 126 180° apart. As a result, when fully installed, a trailing portion of each carrier plate segment 106 and 110 overlaps a leading portion of the other carrier plate segment 110 and 106. For example, a trailing portion of the carrier plate segment 106, i.e. the portion underlying the blanket sheet segment 104, overlaps a leading portion of the other carrier plate segment 110, i.e. the portion of the carrier plate segment 110 between its leading edge 126 and a leading edge 130 of its blanket sheet segment 108. As with the embodiment of FIG. 3, each carrier plate segment 106 and 110 includes an offset bend 132 and 134, respectively, to provide a generally smooth and continuous outer surface.

Figure 6:
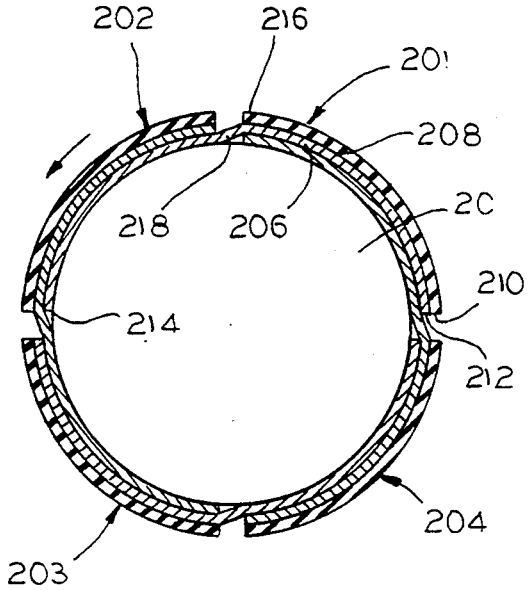
FIG. 6 is a diagram illustrating a printing blanket in section according to another alternative embodiment of the invention mounted on a magnetic cylinder.

With a double sized blanket cylinder printing four-around, the printing blanket may be provided in four 90° segments 201–204, see FIG. 6. For simplicity, only the first segment 201 is described in detail, the other segments 202–204 being identical in construction.

The first segment 201 comprises an elongate carrier plate segment 206 of magnetic material having a length approximately half the circumference of the cylinder 20. An elongate blanket sheet segment 208 has a length approximately one-fourth the circumference of the cylinder 20. The blanket sheet segment 208 is secured to the carrier plate segment 206 with a trailing edge 210 of the blanket sheet segment immediately adjacent a trailing edge 212 of the carrier plate segment 206. In use, the four segments are mounted by positioning a leading edge 214 of each segment 90° apart and then rotating the cylinder 20 to mount the same so that a trailing portion of each carrier plate segment 206 overlaps a leading portion of a circumferentially trailing carrier plate segment, as illustrated. For the first segment 201, this eliminates peel-off of a leading edge 216 of the blanket sheet segment 208, and similarly for the other segments 202–204. Each carrier plate segment 206 includes an offset bend 218, separating the carrier plate into a leading portion and a trailing portion, similar to that discussed above relative to the embodiments of FIGS. 3 and 5.

Figure 7:
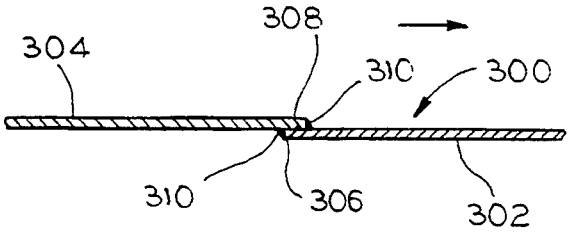
FIG. 7 is a sectional view illustrating a carrier plate for any of the printing blankets of FIGS. 4–6 according to an alternative embodiment of the invention.

In each of the embodiments discussed above, the carrier plate includes an offset bend defining a separation between a leading portion and an overlapping trailing portion. In accordance with an alternative embodiment of the invention, as illustrated in FIG. 7, a carrier plate 300 comprises a two-piece carrier plate comprising a leading piece 302 and a trailing piece 304. A trailing edge 306 of the leading piece 302 is secured at an underside of a leading edge 308 of the trailing piece 304 such as by welds 310.

The carrier plate 300 of FIG. 7 can be used in connection with any of the embodiments of FIGS. 3–6, as necessary or desired. Such a structure provides an overlapping trailing portion without the need to provide a bend in the carrier plate.

Figure 8:
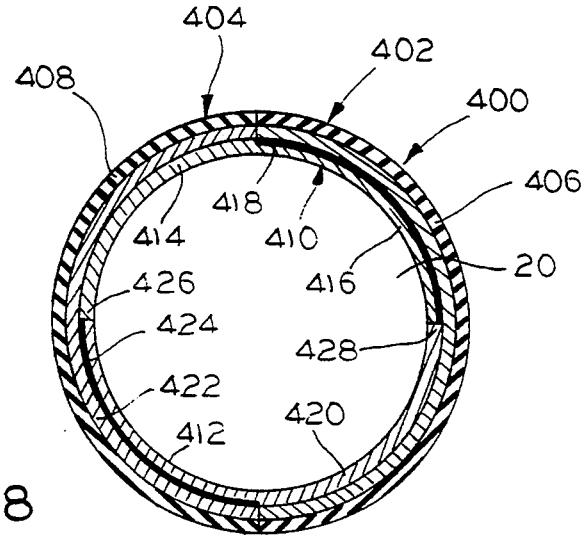
FIG. 8 is a diagram illustrating a printing blanket in section according to still another alternative embodiment of the invention mounted on a magnetic cylinder.

With reference to FIG. 8, a two segment printing blanket 400 according to an alternative embodiment of the invention is illustrated. In the embodiment of FIG. 8, the step of offset in the carrier plate is achieved by lamination.

Particularly, the printing blanket 400 comprises a first segment 402 and a second segment 404. Each segment 402 and 404 includes a respective blanket sheet segment 406 and 408 identical to the segments 104 and 108 discussed above relative to FIG. 5. Each segment 402 and 404 includes a respective two-piece carrier plate segment 410 and 412. The first carrier plate segment 410 comprises two elongate sheets 414 and 416 of magnetic material. A trailing half of the first sheet 414 is secured as by an adhesive layer 418 to the underside of the leading half of the second sheet 416. Similarly, with the second segment 412, a trailing half of a first sheet 420 is secured at the underside of the leading half of a second sheet 422 as with an adhesive layer 424.

To mount the segments 402 and 404, leading edges 426 and 428 of the carrier plate first pieces 414 and 420 are positioned 180° apart and the cylinder 20 is then rotated to install the same. As a result, the leading edge 426 and 428 of each carrier plate 410 and 412 is overlapped by the second carrier plate piece 422 and 416, respectively of the other carrier plate segment 412 and 410.

With the use of a weld configuration, as in FIG. 7, or an adhesive configuration, as in FIG. 8, a minimal gap results. Particularly, the gap is less than that required when a bend is used to provide overlapping as in the embodiments of FIGS. 3, 5 and 6.

As is apparent, the laminated structure of FIG. 8 is a variation on that of FIG. 7 with the overlap of the two pieces of the carrier plate being selected to provide quadrants of varying size and distribution around the cylinder.

Although the laminated carrier plate segment pieces are illustrated secured using an adhesive, other securing means such as brazing or soldering could be utilized as well.

Although the illustrated embodiment relates to a printing plate in the form of a blanket for a blanket cylinder, the concepts described herein are equally applicable to a plate for a plate cylinder.

Figure 9:
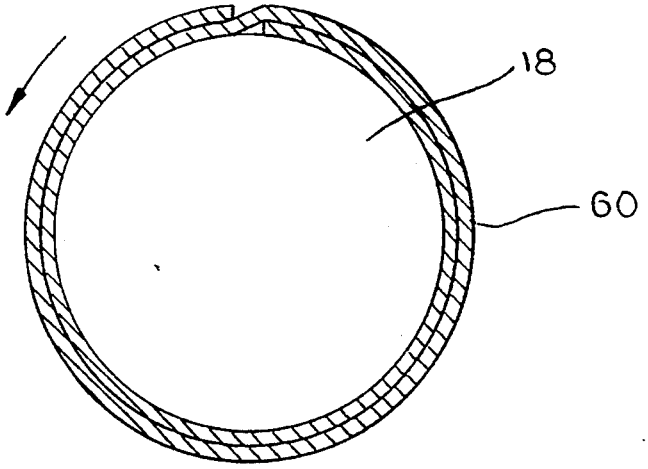
FIG. 9 is a diagram illustrating in section a printing plate according to the invention mounted on a magnetic cylinder.
Figure 10:
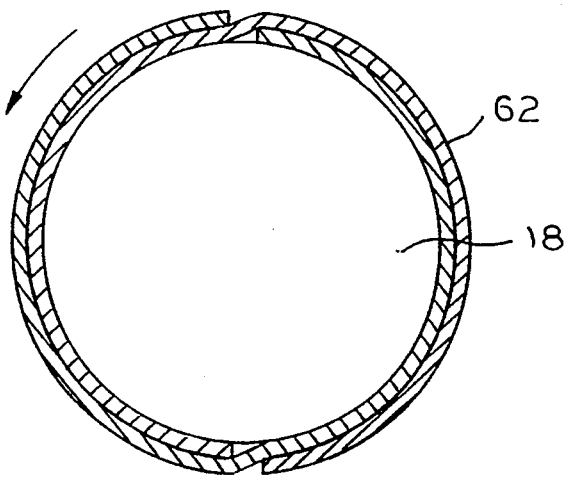
FIG. 10 is a diagram illustrating in section a printing plate according to an alternative embodiment of the invention mounted on a magnetic cylinder.
Figure 11:
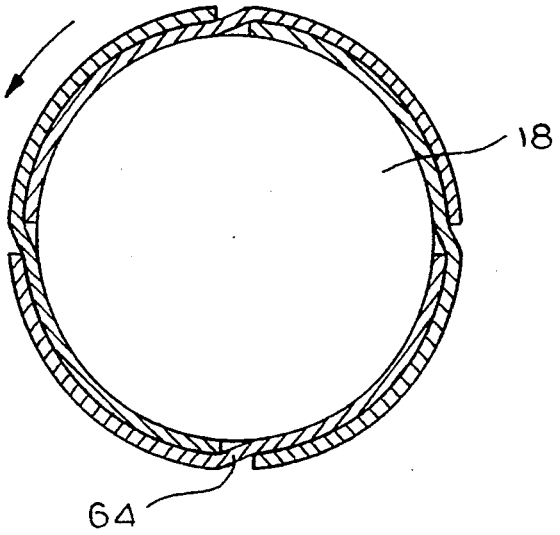
FIG. 11 is a diagram illustrating in section a printing plate according to another alternative embodiment of the invention mounted on a magnetic cylinder.

Particularly, FIG. 9 illustrates a printing image plate 60 according to a first embodiment of the invention mounted to the plate cylinder 18. The printing plate 60 comprises an elongate plate of magnetic material having a length approximately double the circumference of the magnetic plate cylinder 18. Similar to the carrier plate 42 shown above relative to FIG. 3, a leading edge is overlapped by a trailing portion. FIG. 10 similarly illustrates a two segment printing image plate 62 mounted to the image cylinder 18. Each segment is substantially equal in length to the circumference of the cylinder 18, as with the carrier plate segments 106 and 110 discussed above relative to FIG. 5. Finally, FIG. 11 illustrates a four segment printing plate 64 mounted to the plate cylinder 18. As with the carrier plate segment 206 of FIG. 6, each segment has a length approximately half the circumference of the cylinder 18.

Thus, in accordance with the invention, a printing blanket for use on a magnetic cylinder in a web offset press is provided with a portion of a carrier plate overlapping a leading edge of the same or another carrier plate segment to prevent peel-off and suppress circumferential movement of the printing blanket.

I claim:

1. A printing blanket for use on a magnetic cylinder in a web offset press, the cylinder having a select circumference, comprising:

an elongate carrier means of magnetic material comprising one or more carrier plates having a combined length greater than the select circumference of the cylinder;

an elongate blanket means comprising one or more blanket sheets, one for each carrier plate, having a combined length substantially equal to the select circumference of the cylinder; and means securing each blanket sheet to an outer surface of one of the carrier plates with a trailing edge of the blanket sheet immediately adjacent a trailing edge of the carrier plate so that in use mounted to the cylinder at least a portion of a trailing end of each carrier plate overlaps a leading edge of the one or another of the one or more carrier plates.

2. The printing blanket of claim 1 wherein the one or more carrier plates have a length substantially twice as long as the select circumference of the cylinder.

3. The printing blanket of claim 1 wherein said printing blanket comprises a two segment blanket having two carrier plates and two blanket sheets, and said securing means secures each blanket sheet to an outer surface of one carrier plate with a trailing edge of the blanket sheet immediately adjacent a trailing edge of the carrier plate so that in use mounted to the cylinder a portion of a trailing end of each carrier plate overlaps a leading edge of the other carrier plate.

4. The printing blanket of claim 1 wherein said printing blanket comprises a four segment blanket having four carrier plates and four blanket sheets, and said securing means secures each blanket sheet to an outer surface of one carrier plate with a trailing edge of the blanket sheet immediately adjacent a trailing edge of the carrier plate so that in use mounted to the cylinder a portion of a trailing end of each carrier plate segment overlaps a leading edge of another circumferentially adjacent carrier plate segment.

5. The printing blanket of claim 1 wherein each said carrier plate includes an offset bend immediately adjacent a leading edge of the secured blanket sheet.

6. The printing blanket of claim 1 wherein each said carrier plate comprises a two piece carrier plate and a trailing edge of a leading piece is secured at an underside of a leading edge of a trailing piece.

7. The method of assembling a printing blanket for use on a magnetic cylinder in a web offset press, the cylinder having a select circumference, comprising the steps of:

providing an elongate carrier means of magnetic material comprising one or more carrier plates having a combined length greater than the select circumference of the cylinder;

providing an elongate blanket means comprising one or more blanket sheets, one for each carrier plate, having a combined length substantially equal to the select circumference of the cylinder; and securing each blanket sheet to an outer surface of one of the carrier plates with a trailing edge of the blanket sheet immediately adjacent a trailing edge of the carrier plate so that in use mounted to the cylinder at least a portion of a trailing end of each carrier plate overlaps a leading edge of the one or another of the one or more carrier plates.

8. The method of claim 7 wherein said first providing step comprises providing the one or more carrier plates having a length substantially twice as long as the select circumference of the cylinder.

9. The method of claim 7 wherein said printing blanket comprises a two segment blanket having two carrier plates and two blanket sheets, and said securing step comprises securing each blanket sheet to an outer surface of one carrier plate with a trailing edge of the blanket sheet immediately adjacent a trailing edge of the carrier plate so that in use mounted to the cylinder a portion of each carrier plate overlaps a leading edge of the other carrier plate.

10. The method of claim 7 wherein said printing blanket comprises a four segment blanket having four carrier plates and four blanket sheets, and said securing step comprises securing each blanket sheet to an outer surface of one carrier plate with a trailing edge of the blanket sheet segment immediately adjacent a trailing edge of the carrier plate segment so that in use mounted to the cylinder portion of a trailing end of each carrier plate segment overlaps a leading edge of another circumferentially adjacent carrier plate segment.

11. The method of claim 7 wherein said first providing step comprises providing an offset bend in each said carrier plate immediately adjacent a leading edge of the secured blanket sheet.

12. The method of claim 7 wherein said first providing step comprises providing a two piece carrier plate and securing a trailing edge of a leading piece under a leading edge of a trailing piece.

13. A printing blanket for use on a magnetic cylinder in a web offset press, the cylinder having a select circumference, comprising:

an elongate carrier means of magnetic material comprising one or more carrier plates having a combined length substantially equal to twice the select circumference of the cylinder;

an elongate blanket means comprising one or more blanket sheets, one for each carrier plate, having a combined length substantially equal to the select circumference of the cylinder; and means securing each blanket sheet to an outer surface of one of the carrier plates with a trailing edge of the blanket sheet immediately adjacent a trailing edge of the carrier plate so that in use mounted to the cylinder a trailing portion of the carrier plate overlaps a leading portion of the one or another of the one or more carrier plates adjacent its leading edge.

14. The printing blanket of claim 13 wherein said printing blanket comprises a two segment blanket having two carrier plates and two blanket sheets, and said securing means secures each blanket sheet to an outer surface of one carrier plate with a trailing edge of the blanket sheet immediately adjacent a trailing edge of the carrier plate so that in use mounted to the cylinder a trailing portion of each carrier plate overlaps a leading portion of the other carrier plate.

15. The printing blanket of claim 14 wherein each said carrier plate segment comprises a two piece carrier plate segment and for each segment a trailing portion of a leading piece is secured under a leading portion of a trailing piece.

16. The printing blanket of claim 13 wherein said printing blanket comprises a four segment blanket having four carrier plates and four blanket sheets, and said securing means secures each blanket sheet segment to an outer surface of one carrier plate segment with a trailing edge of the blanket sheet segment immediately adjacent a trailing edge of the carrier plate segment so that in use mounted to the cylinder a trailing portion of each carrier plate segment overlaps a leading portion of a circumferentially trailing carrier plate segment.

17. The printing blanket of claim 13 wherein each said carrier plate includes an offset bend immediately adjacent a leading edge of the secured blanket sheet separating said carrier plate trailing and leading portions.

18. The printing blanket of claim 13 wherein each said carrier plate comprises a two piece carrier plate and a trailing edge of a leading piece, comprising said leading portion, is secured under a leading edge of a trailing piece, comprising said trailing portion.

* * * * *